United States Patent [19]

Gassew et al.

[11] Patent Number: 4,553,279

[45] Date of Patent: Nov. 19, 1985

[54] MULTI-PURPOSE PAINT STICK

[76] Inventors: Garry L. Gassew, 1431 Linden La., West Chester, Pa. 19380; Byron Samaras, 369 San Miguel Dr., Ste. 305, Newport Beach, Calif. 92660

[21] Appl. No.: 542,266

[22] Filed: Oct. 17, 1983

[51] Int. Cl.[4] ..... B44D 3/06; B44D 3/12; A46B 17/06

[52] U.S. Cl. ..... 7/105; 366/129; 366/605; 30/172; 15/236 R; 15/105

[58] Field of Search ..... 7/105, 169; 366/605, 366/343, 129; 30/169, 172; 15/236 R, 104.5–104.54, 105; 416/70 R, 71

[56] References Cited

U.S. PATENT DOCUMENTS

| | | | |
|---|---|---|---|
| D. 141,321 | 5/1945 | Gallagher | 7/169 |
| 1,498,509 | 6/1924 | Arnold | 366/129 |
| 1,546,548 | 7/1925 | MacCune | 15/104.5 |
| 1,732,714 | 10/1929 | Copes | 366/605 |
| 2,579,930 | 12/1951 | King | 7/105 |
| 2,777,676 | 1/1957 | Carter | 366/129 |
| 2,860,858 | 11/1958 | Kurs | 30/169 |
| 3,789,450 | 2/1974 | Mozdenski | 15/105 |
| 4,132,502 | 1/1979 | Bunke | 416/70 R |
| 4,324,018 | 4/1982 | Olsson | 15/236 R |

*Primary Examiner*—Roscoe V. Parker

[57] ABSTRACT

A multi-purpose paint stick is described. The paint stick allows a painter to scrape paint from the inside of various size cans, to comb his paint brush to remove unwanted particles, to suspend a paint strainer over a can to mix paint, to measure exact amounts or proportional amounts of components of a multicomponent paint, to support the paint stick over an open paint can to allow draining, to hang the paint stick on a dowel or thin piece of wire to allow draining and to support paint brushes over an open can to allow paint to drain therefrom.

18 Claims, 5 Drawing Figures

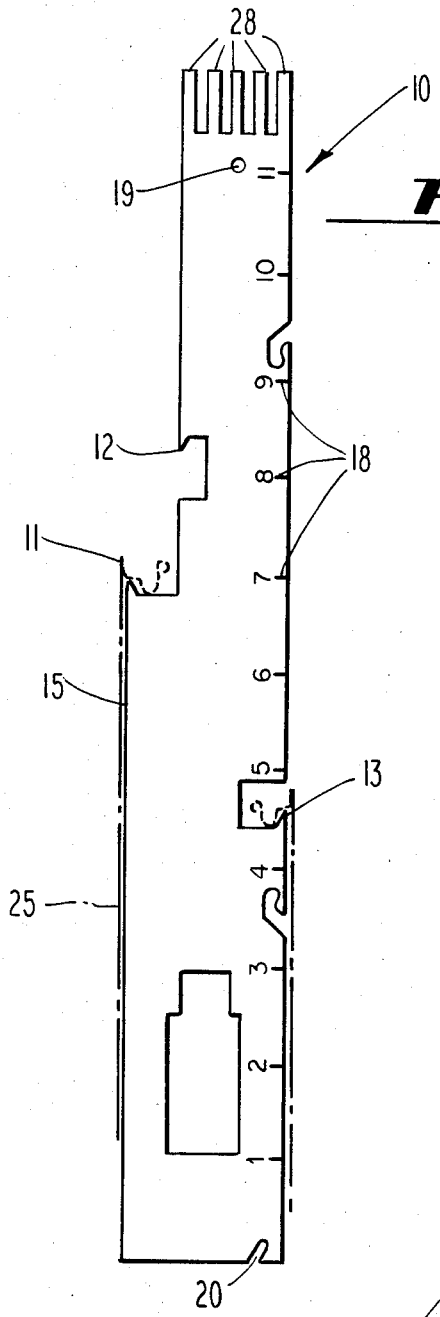
Fig. 1
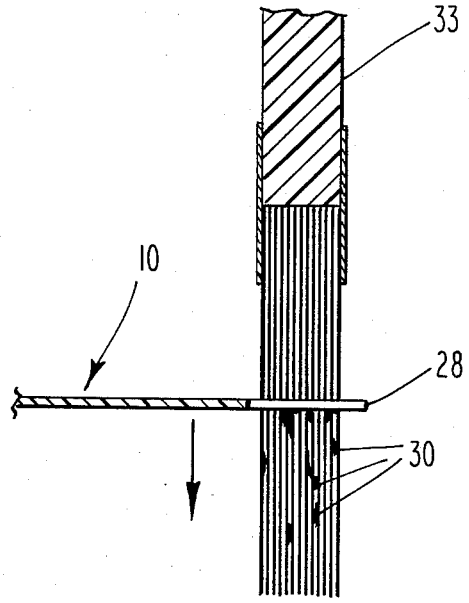
Fig. 3
Fig. 2
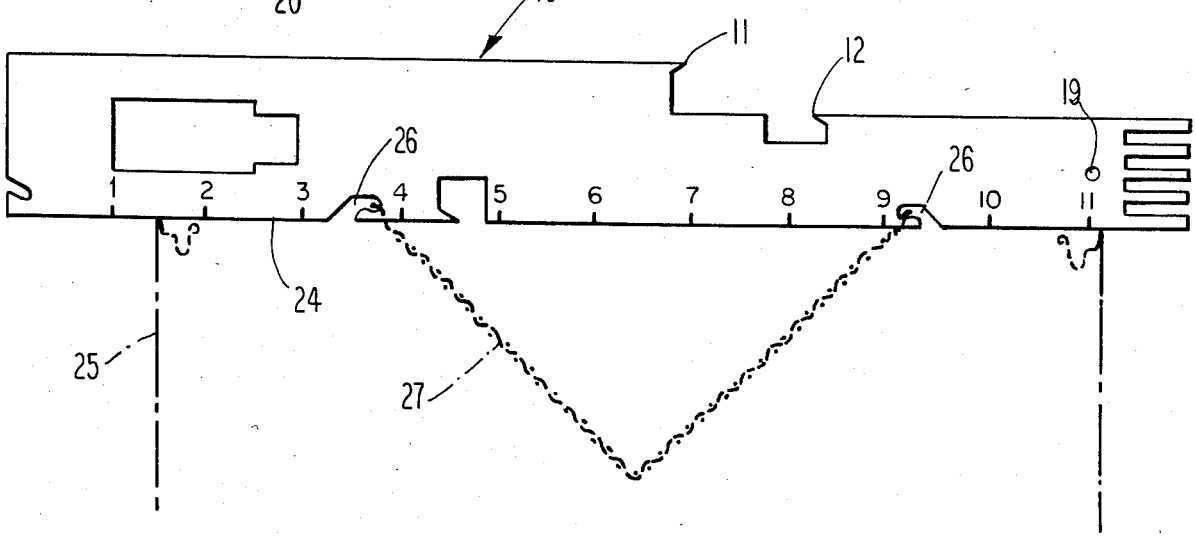

MULTI-PURPOSE PAINT STICK

BACKGROUND OF THE PRIOR ART

The present invention relates to the painting trades, and more particularly to an implement to perform the individual steps that a painter must take while pursuing his trade.

Applying a coat of paint to protect the outside surface, or the inside surface, of an object, be it a building, woodwork or a yacht or sailboat, is a step that must be performed with care and skill. Generally there has been a substantial investment in the underlying object and it will be foolish to depreciate its value by applying a coat of paint so that the beauty or utility is ruined. This is especially true in the boating industry where special marine paints are extremely expensive in themselves and it is necessary to conserve as much of the paint as possible while it is being applied.

Generally, paints come in standard sized cans: the pint, the quart, or the gallon. In addition, there are other implements used by the painter, such as brushes and strainers, that are of different sizes. When a painter starts out to perform a job, he does not know until after starting the job how many different sized brushes and paint cans he will be using for that job. Until the present invention, there has not been produced a single article that will fulfill a multitude of functions for the painter once he starts working.

SUMMARY OF THE INVENTION

A multi-purpose paint stick is disclosed that allows a painter to perform a multitude of tasks with one implement. The paint stick is in the form of a flat, generally elongated rectangle, with one end thereof being more narrow than the other end. The narrow end is in the form of a comb-like structure of sturdy teeth that may be run through a paint brush full of paint or other foreign objects or material and thereby scrape out any unwanted materials. The wider end of the paint stick has a slanted notch conveniently located towards the straight side to allow the stick to be placed onto the rim of a paint can such that it will drip into the paint can and allow drainage thereof. On opposite sides of the paint stick are offset points that efficiently scrape all paint from underneath the inside of the rim of a gallon, a quart and a pint paint can. The straight side is marked into equal increments to allow proportional mixing of multi-component paints, and has cut therein spaced apart hanging slots to allow the rings on a paint strainer cone to hang therefrom as the stick straddles the paint can. Finally, the stick has a plurality of rectangular-shaped apertures cut through the middle thereof to allow paint brushes to hang therefrom by the top ends of the handles.

OBJECTS OF THE INVENTION

It is therefore an object of the present invention to provide a multi-purpose paint stick that will allow a painter to perform a multitude of tasks with one implement.

It is another object of the invention to provide a multi-purpose paint stick that will allow a painter to conserve as much of his paint as possible by providing a scraping implement that will scrape the paint from inside the rim of the paint can.

It is still another object of the invention to provide a multi-purpose paint stick that is economical to produce.

It is a further object of the invention to provide a multi-purpose paint stick that is easily produced.

These and other objects of this invention will be clear from the following specification, and are not to be construed as limiting the scope of the invention thereto, since in view of the disclosure herein, others may be able to make additional embodiments within the scope of the appended claims.

BRIEF DESCRIPTION OF THE DRAWINGS

FIG. 1 is a plan view of the multi-purpose paint stick showing scraping use in gallon and quart cans (in phantom) with the ruler side for mixing of multi-component paints.

FIG. 2 is a front view of a multi-purpose paint stick showing use as a strainer holder (with strainer and paint can in phantom).

FIG. 3 is a partially fragmented side view showing use of the paint-comb end scraping extraneous matter from a paint brush (in phantom).

DESCRIPTION OF THE PREFERRED EMBODIMENT

Figure 4:
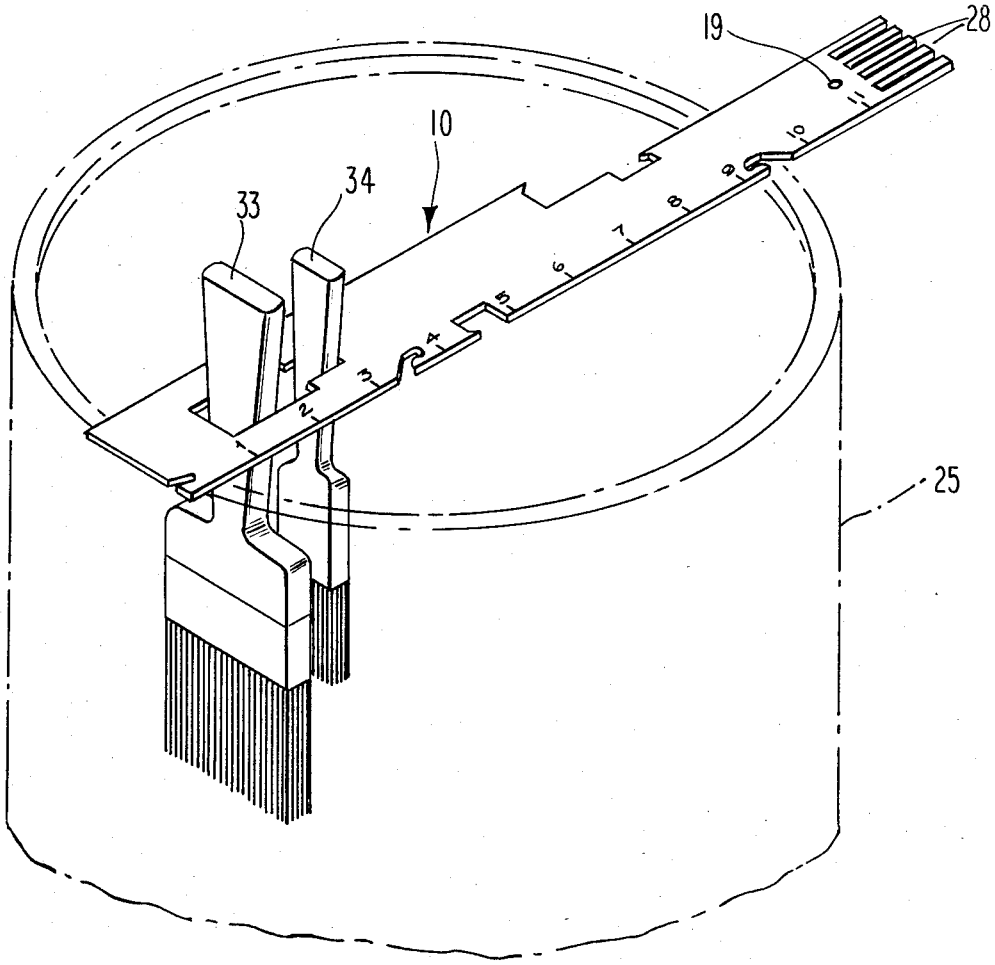
FIG. 4 is a plan view showing use of a multi-purpose stick as a paint brush holder (the paint brush and paint can in phantom).

FIG. 1 shows a multi-purpose paint implement or stick 10 in a partially fragmented view as it is used in its rim-scraping mode, to scrape paint from inside the rim of a gallon paint can as shown on the left in phantom, and a quart paint can as shown on the right in phantom. Paint stick 10 is an elongated rectangular shape made of a generally flat material, such as thin wood or extruded plastic. Alternately, paint stick 10 can be stamped out of sheets of thin material, either metal or wood. Paint stick 10 is constructed to the predetermined length so that paint can scraping means such as offset points 11, 12, and 13 precisely fit underneath the rims of various sized paint cans (shown in phantom). A gallon-can point 11 and pint-can point 12 are placed at the predetermined precise points along edge 15 so as to fit underneath the rim of gallon-and pint-sized paint cans, respectively. In addition, when paint stick 10 is reversed a quart-can point 13 is constructed at the predetermined distance to fit underneath the inner rim of a quart-size paint can (shown in phantom). The paint stick is constructed to have a generally linear side with the quart lip cut into that side. As shown in FIG. 1, paint stick 10 is constructed to have a wider dimension at one end and point 11 is carried along the length of the paint stick so as to scrape a gallon can. A ledge extends inward from gallon point 11 to a corner from which paint stick 10 continues along the length. Quart point 12 and pint point 13 are formed in similar fashion at proper spacing. The total length of multi-purpose paint stick 10 is a predetermined length, and along the straight edge, markings 18 are placed to indicate equal distances for a purpose to be described later.

At the broader end of paint stick 10 is a slanted notch 20 and at the opposite end thereof are a plurality of comb-like or slender fingers 28. When used in the rim-scraping mode, paint stick 10 is inserted in either a gallon paint can 25 (shown in phantom) or a quart paint can or a pint paint can, and rotated around the inside surface of the paint can. In this manner, a large savings of paint that has collected under said rim can be realized. When very expensive paint is being used, this savings can be substantial in terms of the volume of paint that may be recovered.

FIG. 2 shows the multi-purpose paint stick 10 being used in its paint strainer or filter holding mode. In this mode, paint stick 10 is placed across the edges of a can 25 (shown in phantom) in which components of paint or the colors of paint are to be mixed. Stick 10 is placed across the can so that the linear edge 24 extends downward. Two, equally spaced, strainer notches 25 are cut into the linear edge. In a preferred embodiment, the notches are formed by making an initial cut at an angle of approximately 16 to 30 degrees from the horizontal towards the opposite edge. After a predetermined distance, the cut is made at a horizontal to the edge for another predetermined distance and ends in a slight depression such that when a ring from a paint strainer is slipped through the notch it will be positively held in the depression. The opposite notch is cut into the straight edge so as to face the first notch and allow the two oppositely opposed ring tabs from a strainer 27 to be placed thereover such that strainer 27 is forced into an open cone shape. In this manner, strainer 27 is guaranteed to stay in the proper shape while paint is being poured therethrough.

FIG. 3 shows a perspective view of the comb-like end of paint stick 10 being used to comb out unwanted particles and substances from a paint brush 33. As seen in FIGS. 1 and 2, the smaller end of paint stick 10 has a plurality of thin finger-like projections 28 depending therefrom, in between each projection 28 is a slight space, so as to allow paint stick 10 to be used to run through a paint brush and scrape out particles, such as at 30, of a desired size. The size of finger 28 and of the spaces between the teeth are predetermined and can vary from a rather course grade to a fine grade.

FIG. 4 shows paint stick 10 being used in its paint brush holder mode. Paint stick 10 is placed across paint can 25 (shown in phantom) with a flat edge facing down. A series of rectangular shaped cuts 31, 32 are made through the broad end of paint stick 10, the second cut 32 being of a smaller width than the first cut 31. Although only two rectangular cuts are shown, it is possible to place more than two in stick 10. These cuts allow a paint brush as at 33, to hang through the paint stick as it drains into the paint can. The paint brush is placed in a sideways manner to allow the handle to slip through a respective rectangular cut such that the bulge in the top of the paint brush handle is above the cut. The paint brush is then rotated one-quarter turn to allow the shoulders of the bulge to rest on the rectangular cut.

Figure 5:
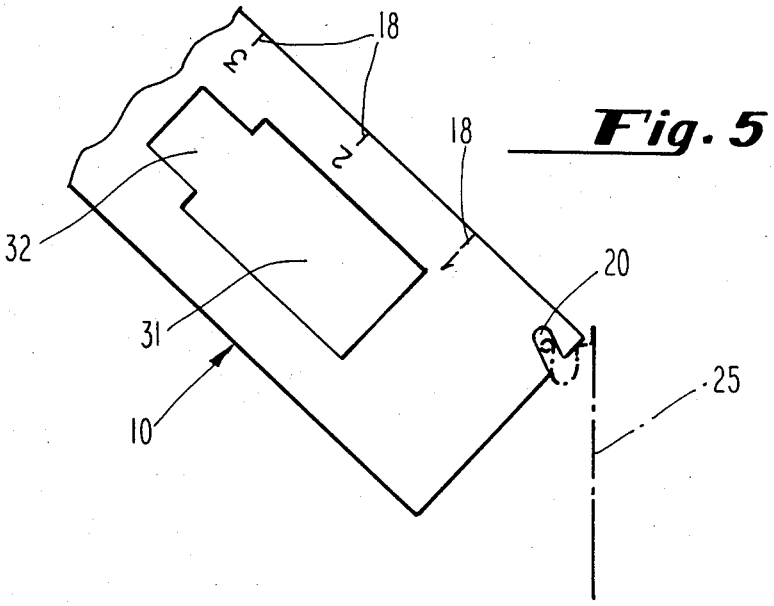
FIG. 5 shows a fragmented side view of the multi-purpose paint stick in its drainer position on a paint can rim (in phantom).

FIG. 5 shows the paint stick in its paint draining mode. In the paint draining mode, the notch or slit 20 at the wide end of paint stick 10 is inserted onto the rim on the inside of paint can 25 (shown in phantom). Notch 20 is angled at a predetermined angle anywhere in the range from 15 to 30 degrees from the vertical edge, and of a predetermied thickness of sufficient width to fit over the inner rim 24 (shown in phantom) of a paint can such that paint stick 10 will stand at approximately 30 to 45 degrees over the open paint can 25 (shown in phantom).

As shown in FIGS. 1 and 2, paint stick 10 has at least one small hole 19 drilled through the ends thereof. Hole 19 can be of a predetermined diameter to allow either wooden dowels or metal wire (not shown) to be inserted therethrough and therefore allow paint stick 10 to hang from the dowel or the wire and drain.

Although shown and described in what are believed to be the most practical and preferred embodiments, it is apparent that departures from specific shapes and apparatus described will suggest themselves to those skilled in the art and may be made without departing from the spirit and scope of the invention. We, therefore, do not wish to restrict outselves to the particular instrumentalities illustrated and described, but desire to avail ourselves of all modifications that may fall within the compass of the appended claims.

We claim:

1. A multi-purpose painting implement comprising:

a. an implement body of predetermined length, width and thickness, said body having spaced-apart hanging means at a predetermined location to hold a filter located on a body side;

b. at least one can-scraping means located on a side of said body for cleaning paint from the insides of various sized cans; and c. at least one brush-scraping means located at an end of said body for combing particles out of a brush.

2. An implement as in claim 1 wherein said spaced-apart hanging means comprise notches cut at a predetermined angle in the side of said implement.

3. An implement as in claim 1 further comprising at least one bore of a predetermined size cut through said body in a predetermined location.

4. An implement as in claim 1 or 3 further comprising bracing means located on an end of said body to support said body at a predetermined angle over a paint can.

5. An implement as in claim 4 wherein said bracing means comprises a notch of predetermined width cut in said end.

6. A multi-purpose painting implement comprising:

a. an implement body of predetermined length, width and thickness, said body having spaced-apart hanging means at a predetermined location to hold a filter located on a body side; and b. at least one brush-scraping means located at an end of said body for combing particles out of a brush.

7. An implement as in claim 6 wherein said hanging means comprise notches cut at a predetermined angle in a side of said implement.

8. An implement as in claim 6 wherein said brush-scraping means comprise a plurality of spaced-apart fingers of predetermined width cut in the end of said implement.

9. A multi-purpose painting implement comprising:

a. an implement body of predetermined length, width and thickness, said body having spaced-apart hanging means at a predetermined location to hold a filter located on a body side; and b. at least one can-scaping means on a body side for cleaning paint from the insides of various sized cans.

10. An implement as in claim 9 wherein said hanging means comprise notches cut at a predetermined angle in a side of said implement.

11. An implement as in claim 9 wherein said can-scraping means comprises a point offset from the side at a predetermined distance from the end.

12. A multi-purpose painting implement comprising:

a. an implement body of predetermined length, width and thickness, said body having spaced-apart hanging means at a predetermined location to hold a filter located on a body side; and b. at least one brush-hanging means of a precalculated size located in said body to allow paint to drip from a paintbrush suspended therein.

13. An implement as in claim 12 wherein said hanging means comprise notches cut at a predetermined angle in a side of the body.

14. An implement as in claim 12 wherein said brush-hanging means comprises a rectangular space.

15. A multi-purpose painting implement comprising:

a. an implement body of predetermined length, width and thickness, said body having spaced-apart hanging means at a predetermined location to hold a filter located on a body side; and b. at least one bracing means located in an end of the body for supporting said implement at a precalculated angle over the paint can.

16. An implement as in claim 15 wherein said hanging means comprise notches cut at a predetermined angle in a side of the body.

17. An implement as in claim 15 wherein said bracing means is a notch of predetermined length and width cut at a predetermined angle in the end of the body.

18. A multi-purpose paint stick having, in combination:

a. a plurality of offset points at predetermined points on said stick;

b. a plurality of paint-strainer holding notches;

c. a plurality of paint brush holding rectangular spaces;

d. a plurality of combing fingers; and e. a stick bracing notch at one end thereof.

* * * * *